US009847154B2

(12) United States Patent
Grant et al.

(10) Patent No.: US 9,847,154 B2
(45) Date of Patent: Dec. 19, 2017

(54) COMMUNICATION CABLE INCLUDING A HELICALLY-WRAPPED SHIELDING TAPE

(71) Applicant: Tyco Electronics Corporation, Berwyn, PA (US)

(72) Inventors: Charles Lloyd Grant, Woodstock, CT (US); Andrew John Nowak, Woodstock, CT (US); Thomas Joseph Grzysiewicz, Dayville, CT (US); Paul Leo Grant, Auburn, MA (US); Roger Edward Temple, Stow, MA (US); Victor William Lee, Brighton, MA (US); Rama Krishna Nippani, Shrewsbury, MA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 321 days.

(21) Appl. No.: 14/524,287

(22) Filed: Oct. 27, 2014

(65) Prior Publication Data

US 2016/0064119 A1 Mar. 3, 2016

Related U.S. Application Data

(60) Provisional application No. 62/045,396, filed on Sep. 3, 2014.

(51) Int. Cl.
*H01B 11/10* (2006.01)
*H01R 24/30* (2011.01)
(Continued)

(52) U.S. Cl.
CPC ..... *H01B 11/1025* (2013.01); *H01B 11/1008* (2013.01); *H01R 24/30* (2013.01);
(Continued)

(58) Field of Classification Search
CPC .. H01B 11/1008; H01B 11/1025; H01B 7/14; H01B 7/046; H01B 7/226; H01B 7/2825;
(Continued)

(56) References Cited

U.S. PATENT DOCUMENTS 3,968,321 A * 7/1976 Olszewski ..... H01B 11/085 174/105 R
4,912,283 A * 3/1990 O'Connor ..... H01B 11/1008 174/105 R
(Continued)

OTHER PUBLICATIONS

International Search Report dated Oct. 6, 2016 received in counterpart PCT Application No. PCT/US2015/046716.
Mats Josefsson, et al. "Measuring and Modeling of Insertion Loss in Cables with Helical Screens", International Wire & Cable Symposium, Proceedings of the 60th IWCS Conference, pp. 139-145.
3M Twin Axial Cable, SL8800 Series, Electronic Solutions Division Interconnect Products, Austin, TX, 3M, 2011, pp. 1-3.

*Primary Examiner* — Timothy Thompson
*Assistant Examiner* — Paresh Paghadal

(57) ABSTRACT

Communication cable including insulated conductors and a composite tape having an insulative layer and a conductive layer. The composite tape includes first and second lateral sections that are folded over each other to form a shielding tape. The shielding tape includes opposite inner and outer sides that are formed from the first and second lateral sections, respectively, and a folded edge that joins the inner and outer sides. The conductive layer defines the inner side, the outer side, and the folded edge. The shielding tape is wrapped helically about the insulated conductors a plurality of times along a length of the communication cable to form a plurality of wraps. The inner side of a subsequent wrap of the shielding tape overlaps a portion of the outer side of a prior wrap of the shielding tape.

16 Claims, 5 Drawing Sheets

(51) Int. Cl.

| | |
|---|---|
| *H01B 7/22* | (2006.01) |
| *H01B 7/282* | (2006.01) |
| *H01B 7/04* | (2006.01) |
| *H01B 7/00* | (2006.01) |
| *H01B 7/08* | (2006.01) |

(52) U.S. Cl.
CPC ..... *H01B 7/0018* (2013.01); *H01B 7/046* (2013.01); *H01B 7/0869* (2013.01); *H01B 7/22* (2013.01); *H01B 7/226* (2013.01); *H01B 7/2825* (2013.01); *H01B 11/1091* (2013.01)

(58) Field of Classification Search
CPC ..... H01B 7/2806; H01B 7/0018; H01B 7/22; H01B 7/0869
See application file for complete search history.

(56) References Cited

U.S. PATENT DOCUMENTS

| | | | | |
|---|---|---|---|---|
| 5,866,843 | A * | 2/1999 | Ikeda | B60R 16/0215 174/36 |
| 7,790,981 | B2 | 9/2010 | Vaupotic et al. | |
| 2010/0108350 | A1* | 5/2010 | Cases | H01B 13/26 174/102 R |
| 2011/0247856 | A1* | 10/2011 | Matsuda | H01B 11/203 174/108 |
| 2012/0152589 | A1* | 6/2012 | Kumakura | H01B 11/20 174/109 |
| 2012/0273248 | A1* | 11/2012 | Tamaki | H01B 11/1025 174/102 SP |

* cited by examiner

COMMUNICATION CABLE INCLUDING A HELICALLY-WRAPPED SHIELDING TAPE

CROSS-REFERENCE TO RELATED APPLICATION

The present application claims the benefit of U.S. Provisional Application No. 62/045,396, filed on Sep. 3, 2014 and having the same title. The above application is incorporated herein by reference in its entirety.

BACKGROUND

The subject matter herein relates generally to a communication cable that includes a plurality of insulated conductors and a helically-wrapped shielding tape that surrounds the insulated conductors.

Communication cables include insulated conductors that extend alongside each other for a length of the communication cable. For instance, a communication cable may include a pair of the insulated conductors extending parallel to each other. Examples of such communication cables include twin-axial cables, which are also referred to as Twinax or twin-axial cables. The insulated conductors may be surrounded by a shielding tape that, in turn, is surrounded by a cable jacket. The shielding tape includes a conductive foil that functions to shield the insulated conductors from electromagnetic interference (EMI) and generally improve performance.

In a conventional twin-axial cable, the shielding tape is a composite tape that includes a plastic backing and a conductive foil. The plastic backing increases the strength of the shielding tape and protects the conductive foil from tearing or other damage. Like other types of tape, the shielding tape includes a lateral edge at an end of the shielding tape and a pair of longitudinal edges that extend parallel to each other along a length of the shielding tape. When the shielding tape of the conventional twin-axial cable is wrapped around the insulated conductors, the conductive foil typically faces radially-inward and engages the insulated conductors. The shielding tape is helically wrapped around the insulated conductors such that the longitudinal edges repeatedly wrap around the insulated conductors in a helical manner.

In the conventional twin-axial cable described above, the shielding tape has numerous "wraps" around the insulated conductors in which each wrap is moved further along the length of the cable with respect to the prior wrap. Each subsequent wrap extends partially over the prior wrap such that a portion of the conductive foil from the subsequent wrap overlaps with a portion of the plastic backing from the prior wrap. Consequently, the conductive foil from the subsequent wrap is electrically isolated from the conductive foil of the prior wrap along this overlapped region. More specifically, the conductive foil of the subsequent wrap and the conductive foil of the prior wrap are separated from each other by the plastic backing of the prior wrap. It is suspected that this electrical isolation along the overlapped region, which also extends around the insulated conductors in a helical manner, causes a "suck-out" effect that limits the data transmission speed of the cable. For example, conventional twin-axial cables having a wrapped shielding tape may have a maximum data transmission speed of 14 Gigabits/second (Gbps).

An alternative twin-axial cable has been used in which the shielding tape is not repeatedly wrapped around the insulated conductors. Instead, the shielding tape is folded over the insulated conductors such that one longitudinal edge of the shielding tape overlaps the opposite longitudinal edge. In this configuration, the longitudinal edges extend generally parallel to the insulated conductors (or a centerline of the cable). Although the folded configuration reduces the suck-out effect, this alternative cable has a limited flexibility compared to the communication cables having shielding tapes that are helically wrapped.

Accordingly, there is a need for a communication cable having a helically-wrapped shielding tape that reduces the suck-out effect.

BRIEF DESCRIPTION

In an embodiment, a communication cable is provided that includes insulated conductors and a composite tape having an insulative layer and a conductive layer. The composite tape includes first and second lateral sections that are folded over each other to form a shielding tape. The shielding tape includes opposite inner and outer sides that are formed from the first and second lateral sections, respectively, and a folded edge that joins the inner and outer sides. The conductive layer defines the inner side, the outer side, and the folded edge. The shielding tape is wrapped helically about the insulated conductors a plurality of times along a length of the communication cable to form a plurality of wraps. The inner side faces the insulated conductors, and the folded edge leads the shielding tape when the shielding tape is wrapped helically about the insulated conductors. The inner side of a subsequent wrap of the shielding tape overlaps a portion of the outer side of a prior wrap of the shielding tape. The folded edge of the prior wrap extends between and electrically couples the inner side of the prior wrap to the inner side of the subsequent wrap.

In some embodiments, the composite tape is folded along a fold line. The insulative layer provides a flex force that biases the first and second lateral sections away from each other proximate to the fold line. The flex force facilitates electrical contact between the outer side of the prior wrap and the inner side of the subsequent wrap. Optionally, the composite tape does not include an adhesive along an exterior of the insulative layer proximate to the fold line.

In an embodiment, a cable assembly is provided that includes a cable bundle of communication cables and a cable connector including a plurality of contact modules that form a two-dimensional contact array of the cable connector. The contact modules are electrically coupled to corresponding communication cables of the cable bundle. At least one of the communication cables including insulated conductors and a shielding tape wrapped helically about the insulated conductors. The shielding tape includes a composite tape that has an insulative layer and a conductive layer. The composite tape includes first and second lateral sections that are folded over each other to form the shielding tape. The shielding tape includes opposite inner and outer sides that are formed from the first and second lateral sections, respectively, and a folded edge that joins the inner and outer sides. The conductive layer includes the inner side, the outer side, and the folded edge. The folded edge leads the shielding tape when the shielding tape is wrapped helically about the insulated conductors. The inner side of a subsequent wrap of the shielding tape overlaps a portion of the outer side of a prior wrap of the shielding tape. The folded edge of the prior wrap electrically couples the inner side of the prior wrap to the inner side of the subsequent wrap.

DETAILED DESCRIPTION

Embodiments set forth herein may include communication cables having insulated conductors and shielding tapes wrapped about the insulated conductors. Embodiments may also include cable assemblies (or components thereof) that include one or more of the communication cables. The shielding tapes set forth herein may include opposite inner and outer sides that are conductive. The shielding tapes may also include at least one edge surface that is conductive and electrically couples the inner and outer sides. When the shielding tape is wrapped about the insulated conductors, the inner side of a subsequent wrap of the shielding tape may overlap and engage the outer side of a prior wrap of the shielding tape. The inner side of the subsequent wrap and the outer side of the prior wrap are electrically coupled to each other.

In particular embodiments, the shielding tape is folded over itself to form a shielding tape. More specifically, the shielding tape may include an insulative layer and a conductive layer, such as a conductive foil. The shielding tape may be folded such that the insulative layer is folded over itself. In this manner, the conductive layer may include at least portions of the inner and outer sides.

Figure 1:
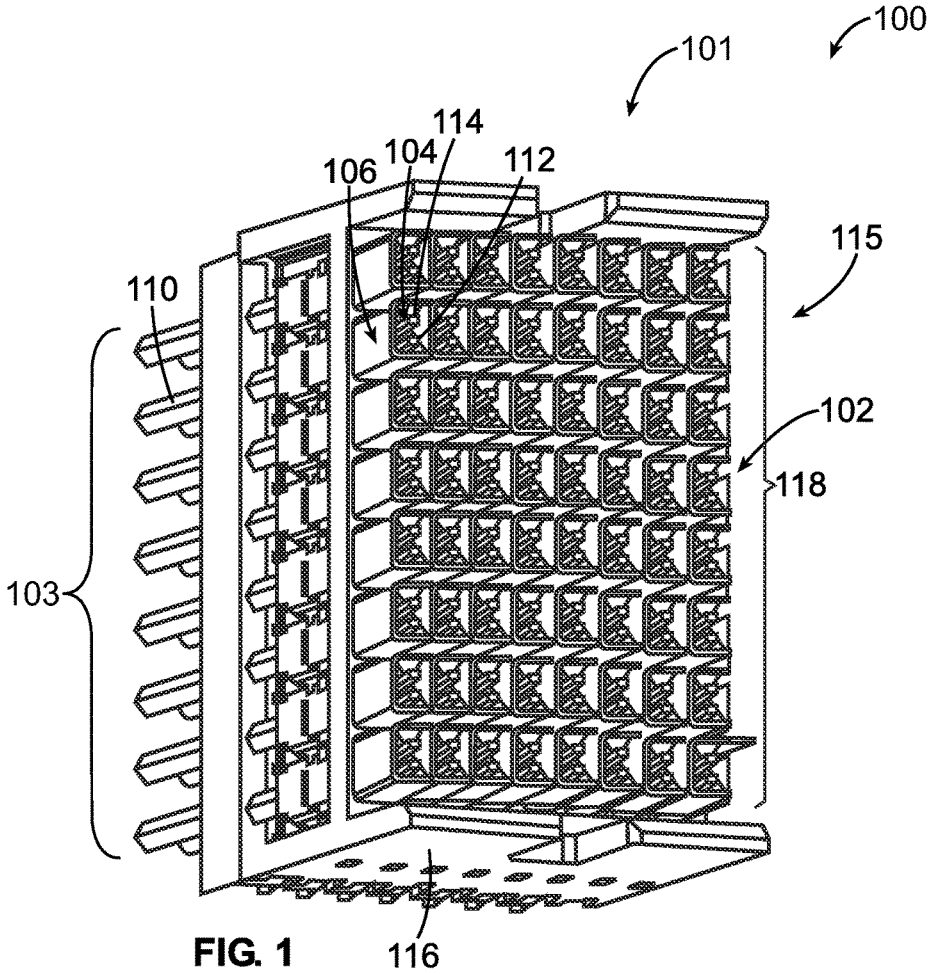
FIG. 1 is a perspective view of a cable assembly formed in accordance with an embodiment.

FIG. 1 is a front perspective view of one end of a cable assembly 100 that includes a cable connector 101 and a cable bundle 103 of communication cables 110. The cable connector 101 includes a plurality of contact modules 102 formed in accordance with one embodiment. Each of the contact modules 102 includes a signal assembly 104 and a shield assembly 106 coupled to the signal assembly 104. Each of the communication cables 110 is electrically coupled to a corresponding signal assembly 104 and to a corresponding shield assembly 106. As shown, the contact modules 102 may be positioned in a two-dimensional contact array 118 along a mating face 115 of the cable connector 101. The cable connector 101 is configured to be mated with a mating connector (not shown), wherein each of the contact modules 102 may engage a corresponding module (not shown) of the mating connector. In the illustrated embodiment, each of the signal assemblies 104 includes first and second signal contacts 112, 114. The signal contacts 112, 114 are at least partially surrounded by the shield assembly 106.

Also shown, the cable connector 101 includes a housing 116 that supports the contact modules 102. The housing 116 holds the contact modules 102 in parallel such that the contact modules 102 are aligned in rows and columns in the contact array 118. FIG. 1 shows one exemplary embodiment, but any number of contact modules 102 may be held by the housing 116 in various arrangements depending on the particular application.

The cable connector 101 is configured to engage the mating connector, which may be board-mounted to a printed circuit board or may be another cable connector. In some embodiments, the cable connector 101 is a high speed cable connector including a number of signal pathways that are configured for differential signaling. For example, the communication cable 110 may be configured to transmit data signals at a data rate or speed of 15 Gigabits per second (Gbps), 20 Gbps, 25 Gbps, or more. As described below, signal wires of the differential pairs are shielded along the communication cables 110 to reduce noise, crosstalk, and other interference.

Figure 2:
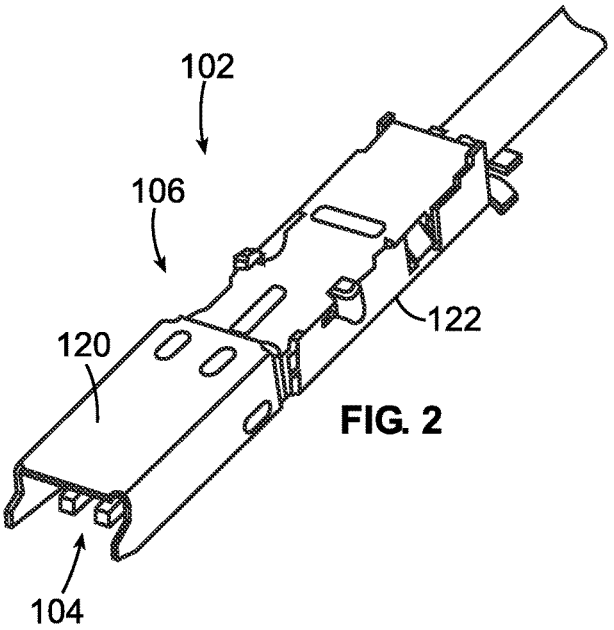
FIG. 2 is a perspective view of an exemplary contact module that may be used with the cable assembly of FIG. 1.
Figure 3:
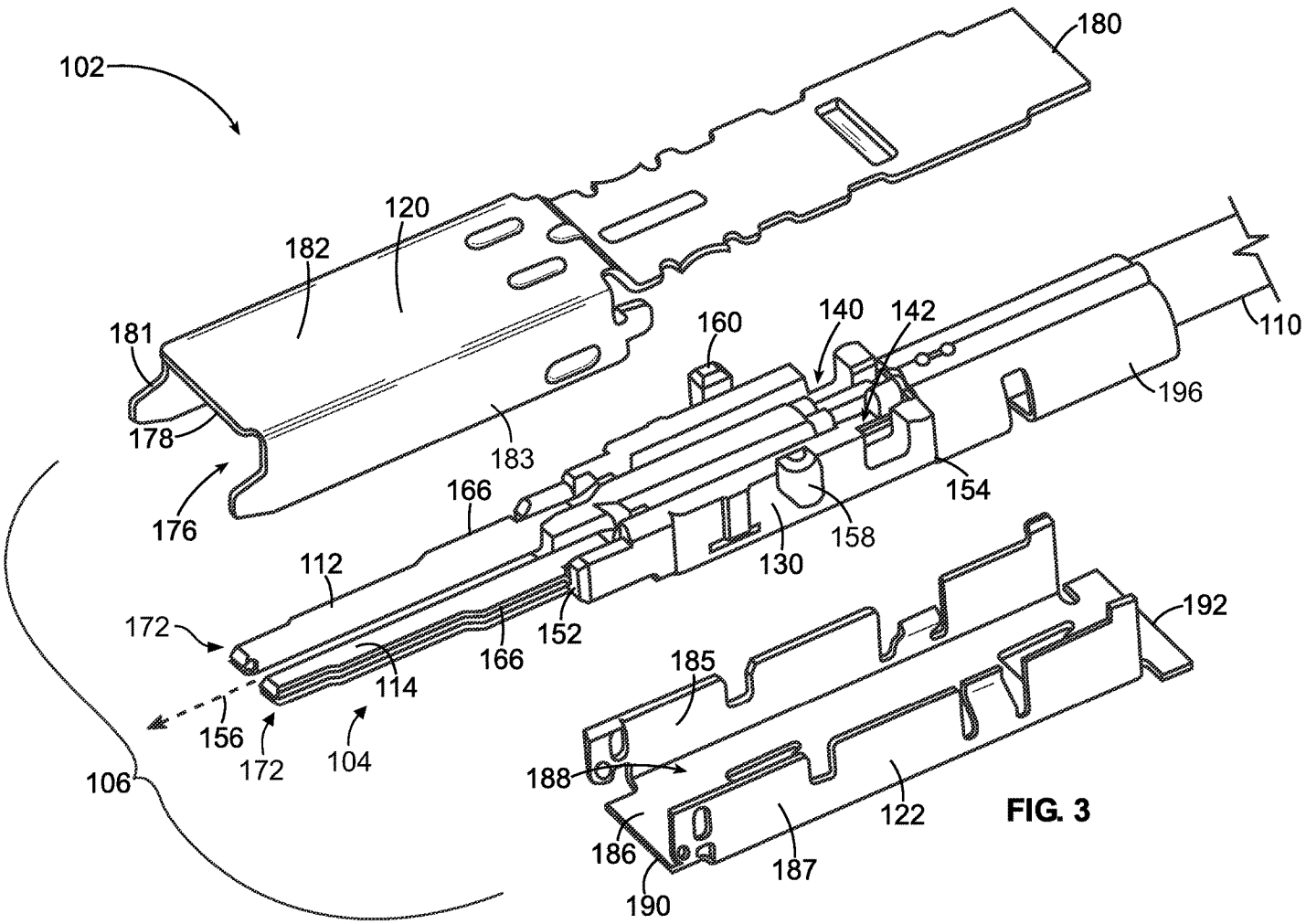
FIG. 3 is an exploded view of the contact module of FIG. 2.

FIG. 2 is an isolated perspective of one of the contact modules 102, and FIG. 3 shows an exploded view of the contact module 102. As shown, the contact module 102 includes the shield assembly 106 and the signal assembly 104. The shield assembly 106 may include a first ground shield (or cover shield) 120 and a second ground shield (or base shield) 122 that are configured to be coupled to each other. The signal assembly 104 is located between the first and second ground shields 120, 122 when the contact module 102 is assembled. In other embodiments, the shield assembly 106 may include only a single ground shield or, alternatively, the shield assembly 106 may include more than two ground shields.

With respect to FIG. 3, the signal assembly 104 includes a mounting block 130 that is configured to hold the signal contacts 112, 114. The mounting block 130 has a leading end 152 and a loading end 154 and extends therebetween along a longitudinal axis 156 of the contact module 102. In the illustrated embodiment, the mounting block 130 has contact channels 140, 142 that are configured to hold the signal contacts 112, 114, respectively. The contact channels 140, 142 are generally open along a top side of the mounting block 130 to receive the signal contacts 112, 114 therein, but may have other configurations in alternative embodiments. The mounting block 130 may include features to secure the signal contacts 112, 114 in the respective contact channels 140, 142. For example, the signal contacts 112, 114 may be held by an interference fit therein. In some embodiments, the mounting block 130 and the contact channels 140, 142 are designed for impedance control of the signal contacts 112, 114.

Figure 6:
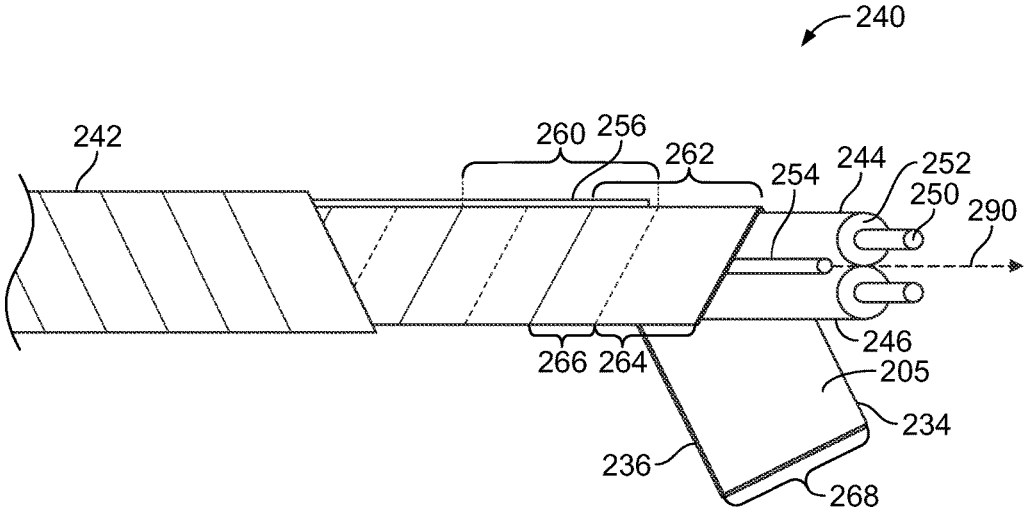
FIG. 6 is a side view of a communication cable as the shielding tape of FIG. 5 is wrapped about insulated conductors.

The mounting block 130 is positioned forward of the communication cable 110. Signal wires from the communication cable 110, such as signal wires 250 shown in FIG. 6, are configured to extend into the mounting block 130 for termination to the signal contacts 112, 114, respectively. The mounting block 130 is shaped to guide or position the signal wires therein for termination. In an exemplary embodiment, the signal wires are terminated to the signal contacts 112, 114 in-situ after being loaded into the mounting block 130. For example, the mounting block 130 may position the signal contacts 112, 114 and the signal wires in direct physical engagement. The signal contacts 112, 114 may be terminated to respective signal wires, such as through welding or soldering.

In an exemplary embodiment, the signal contacts 112, 114 extend forward from the mounting block 130 beyond the leading end 152. The mounting block 130 includes locating posts 158, 160 extending from opposite sides of the mounting block 130. The locating posts 158, 160 are configured to position the mounting block 130 with respect to the ground shield 120 when the ground shield 120 is coupled to the mounting block 130.

The signal contacts 112, 114 may be stamped and formed from conductive sheet material or may be manufactured by other processes. Each of the signal contacts 112, 114 extends lengthwise between a corresponding mating end 172 and a corresponding terminating end (not shown). The signal contacts 112, 114 are configured to be terminated to the signal wires at the terminating ends. In an exemplary embodiment, the signal contacts 112, 114 have pins 166 that include the mating ends 172. The pins 166 extend forward from the leading end 152 of the mounting block 130. The pins 166 are configured to be mated with corresponding electrical contacts (not shown) of the mating connector (not shown).

The ground shield 120 has a plurality of walls 181, 182, 183 that define a first chamber 176 that is configured to receive the signal assembly 104. The ground shield 120 extends between a mating end 178 and a terminating end 180. The mating end 178 is configured to be mated with the mating connector. In the illustrated embodiment, the mating end 178 of the ground shield 120 is positioned either at or beyond the mating ends 172 of the signal contacts 112, 114 when the contact module 102 is assembled. The terminating end 180 of the ground shield 120 is positioned either at or beyond the terminating ends of the signal contacts 112, 114. The ground shield 120 may provide shielding along an entire length of the signal contacts 112, 114.

As shown in FIG. 3, the contact module 102 includes a ground ferrule 196 that is coupled to a terminating end of the communication cable 110. The ground ferrule 196 is configured to be electrically coupled to a drain wire (not shown) and/or a conductive foil (not shown) of the communication cable 110. For example, the ground ferrule 196 may be laser-welded to the drain wire. The ground ferrule 196, in turn, may be coupled to the shield assembly 106. The ground shield 120 may be coupled to the ground ferrule 196. For example, the terminating end 180 of the ground shield 120 may be electrically connected to the ground ferrule 196 through soldering or welding.

The ground shield 122 has a plurality of walls 185, 186, 187 that define a second chamber 188 that receives the signal assembly 104. The ground shield 122 extends between a mating end 190 and a terminating end 192. The mating end 190 is configured to be mated with the mating connector (not shown). Similar to the ground shield 120, the ground shield 122 may provide shielding along the length of the signal contacts 112, 114. When the ground shields 120, 122 are coupled together to form the shield assembly 106, the chambers 176, 188 overlap each other and/or occupy the same space to become a contact cavity of the contact module 102. The signal assembly 104 is configured to be positioned within the contact cavity such that the shield assembly 106 peripherally surrounds the signal assembly 104.

Figure 4:
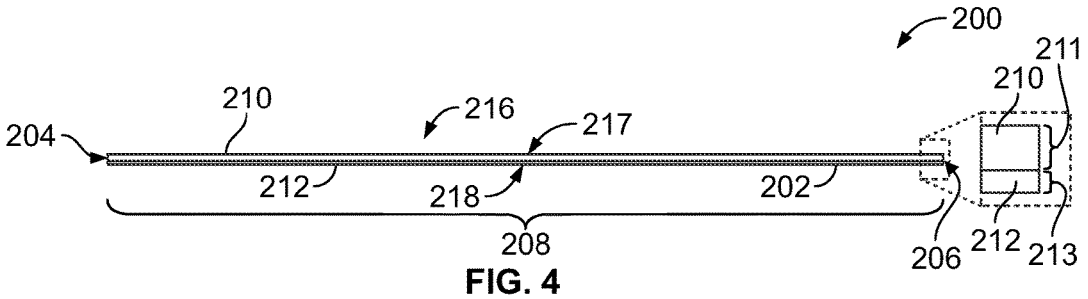
FIG. 4 is an end view of a composite tape in accordance with an embodiment that may be used to form a shielding tape.

FIG. 4 illustrates an end view of a composite tape 200. The composite tape 200 is configured to be folded over itself to form a shielding tape 205 (shown in FIG. 5) that is then helically wrapped about insulated conductors 244, 246 (shown in FIG. 6). As shown in FIG. 4, the composite tape 200 includes a lateral edge 202 that extends between first and second longitudinal edges 204, 206 of the composite tape 200. The lateral edge 202 defines an end of the composite tape 200. The first and second longitudinal edges 204, 206 extend for a length of the composite tape 200, which extends into the page in FIG. 4. The lateral edge 202 extends between the first and second longitudinal edges 204, 206 for a width 208 of the composite tape 200. The width 208 may be, for example, between about 4 millimeters (mm) and about 20 mm. In an exemplary embodiment, the first and second longitudinal edges 204, 206 extend parallel to each other throughout the length of the composite tape 200.

The composite tape 200 includes an insulative layer 210 and a conductive layer 212. The insulative layer 210 includes a side surface 216 of the composite tape 200, and the conductive layer 212 includes a side surface 218 of the composite tape 200. The insulative layer 210 includes a dielectric material that provides structural integrity to the composite tape 200 and protects the conductive layer 212 from damage through, for example, tearing. By way of example, the insulative layer 210 may include polyethylene, polyethylene terephthalate (PET), polyolefin, polytetrafluoroethylene (PTFE), or polyester. In some embodiments, the side surface 216 of the insulative layer 210 may be devoid of an adhesive. However, in other embodiments, the insulative layer 210 may include an adhesive along at least a portion of the side surface 216. For example, the side surface 216 may include an adhesive along an entirety of the side surface 216. In other configurations, the side surface 216 may be devoid of an adhesive proximate to a fold line 217. For example, the fold line 217 may be located approximately halfway between the longitudinal edges 204, 206 or, in other words, at a midpoint between the longitudinal edges 204, 206. The side surface 216 may be devoid of an adhesive for a designated area on either side of the fold line 217.

In some embodiments, the conductive layer 212 may be characterized as a conductive foil. The conductive layer 212 may include aluminum, copper, or the like. In particular embodiments, the conductive layer 212 is devoid of an adhesive along the side surface 218. As shown in the enlarged view of FIG. 4, the insulative layer 210 and the conductive layer 212 have respective layer thicknesses 211, 213.

Figure 5:
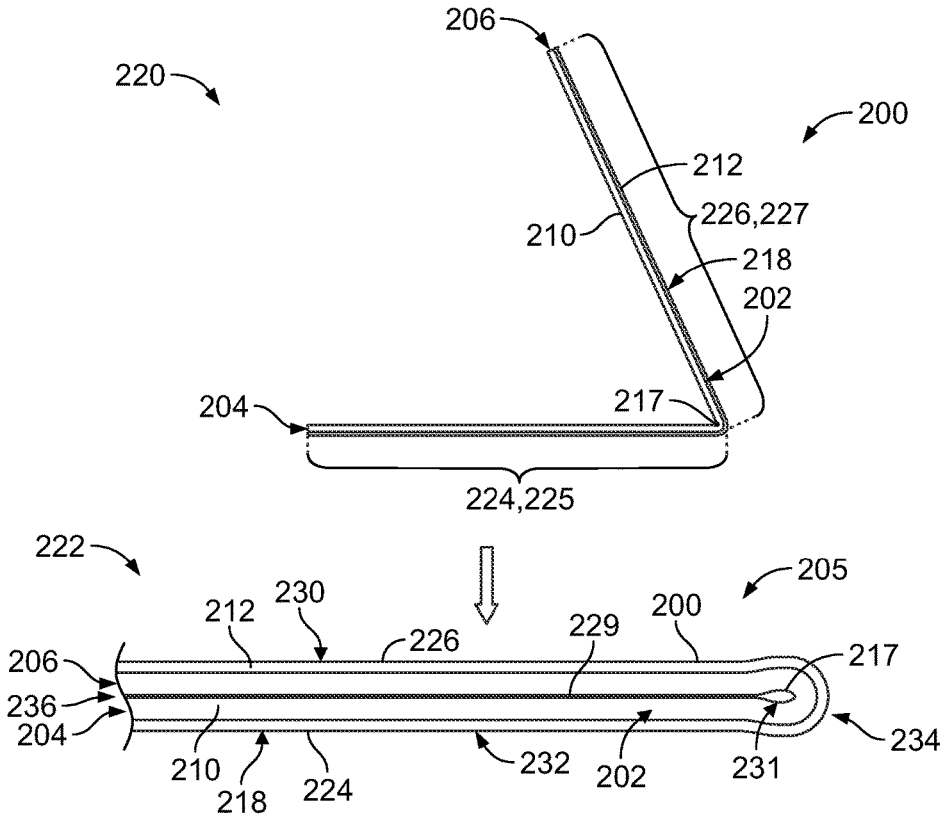
FIG. 5 illustrates end views of the composite tape during a folding operation to form the shielding tape.

FIG. 5 illustrates an end view 220 of the composite tape 200 in a partially folded state and an end view 222 of the shielding tape 205, which is the composite tape 200 after being folded about the fold line 217. The composite tape 200 (or the shielding tape 205) includes a first lateral section 224 and a second lateral section 226. The first and second lateral sections 224, 226 include the first and second longitudinal edges 204, 206, respectively, and extend laterally from the fold line 217 to the first and second longitudinal edges 204, 206, respectively. Each of the first and second lateral sections 224, 226 includes a portion of the lateral edge 202. The fold line 217 and the first and second lateral sections 224, 226 extend lengthwise along the composite tape 200.

In an exemplary embodiment, the first and second lateral sections 224, 226 may be portions of the composite tape 200 that are not readily identified within the composite tape 200 prior to folding the composite tape 200 to form the shielding tape 205. For example, the composite tape 200 may have a continuous composition and uniform cross-section as the composite tape 200 extends laterally between the first and second longitudinal edges 204, 206. The first and second lateral sections 224, 226 may be designated only after determining the fold line 217 that the composite tape 200 is folded along.

In other embodiments, the composite tape 200 may include a structural change and/or a change in composition that defines the fold line 217. In such embodiments, the first and second lateral sections 224, 226 may be identifiable prior to the folding operation. For example, a linear indentation may be pressed into the insulative layer 210 of the composite tape 200 to define the fold line 217 prior to folding the composite tape 200. Alternatively, the composite tape 200 may be manufactured with an included recess or indentation in the insulative layer 210 defining the fold line 217. The recess or indentation may facilitate folding the composite tape 200.

The first lateral section 224 has a section width 225, and the second lateral section 226 has a section width 227. In an exemplary embodiment, the section widths 225, 227 are substantially equal such that the first and second longitudinal edges 204, 206 are located adjacent to each other and extend alongside each other throughout the length of the shielding tape 205. More specifically, the longitudinal edges 204, 206 may combine to form a stacked edge 236 of the shielding tape 205. In other embodiments, the section widths 225, 227 are not equal such that either the first lateral section 224 or the second lateral section 226 extends beyond the longitudinal edge of the other lateral section. Such embodiments are described below.

When the shielding tape 205 is formed, the first and second lateral sections 224, 226 are folded over each other. When fully folded, the first and second lateral sections 224, 226 extend along an interior interface 229 of the shielding tape 205. In some embodiments, one or more air gaps may exist between the first and second lateral sections 224, 226 for at least a portion of the interior interface 229. For example, an air gap 231 may exist proximate to the fold line 217 within the shielding tape 205. In some embodiments, the first and second lateral sections 224, 226 may be secured to each other along at least a portion of the interior interface 229. For example, the insulative layer 210 may include an adhesive. When the first and second lateral sections 224, 226 are folded over each other, the adhesive may secure the first and second lateral sections 224, 226 to each other along the interior interface 229.

When the shielding tape 205 is formed, the side surface 218 of the conductive layer 212 forms nearly an entirety of an exterior or skin of the shielding tape 205. More specifically, the conductive layer 212 defines an outer side 230 of the shielding tape 205, an inner side 232 of the shielding tape 205, and a folded edge 234 of the shielding tape 205. The folded edge 234 is formed when the composite tape 200 is folded about the fold line 217. The folded edge 234 is opposite the stacked edge 236. As shown, the inner and outer sides 232, 230 face in generally opposite directions. The inner side 232 is configured to face the insulated conductors 244, 246 (FIG. 6).

The shielding tape 205 is electrically conductive along the inner and outer sides 232, 230 and along the folded edge 234. More specifically, the conductive layer 212 extends continuously from the first longitudinal edge 204 to the folded edge 234 along the inner side 232 and extends continuously from the folded edge 234 to the second longitudinal edge 206 along the outer side 230. In an exemplary embodiment, the inner and outer sides 232, 230 and the folded edge 234 are electrically conductive throughout the length of the shielding tape 205. Accordingly, the exterior of the shielding tape 205 is electrically conductive, except for a portion of the stacked edge 236. As described below, however, embodiments may include shielding tapes in which both edges of the corresponding shielding tape are electrically conductive.

FIG. 6 is a side view of a communication cable 240 that includes the shielding tape 205. The communication cable 240 is configured to electrically couple to a contact module, such as the contact module 102 (FIG. 1), and may be used with a cable connector, such as the cable connector 101 (FIG. 1). In the illustrated embodiment, the communication cable 240 includes a cable jacket 242, the shielding tape 205, and the insulated conductors 244, 246. The cable jacket 242, the shielding tape 205, and the insulated conductors 244, 246 may extend along a length of the communication cable 240 and may extend along a central or longitudinal axis 290 of the communication cable 240. It should be understood that the communication cable 240 may be a flexible cable and, as such, the central axis 290 is not required to be linear for an entire length of the communication cable 240. Instead, the central axis 290 may extend through a geometric center of a cross-section of the communication cable 240. In the illustrated embodiment, the central axis 290 extends along a tangent line where the insulated conductors 244, 246 interface or contact each other.

In the illustrated embodiment, each of the insulated conductors 244, 246 includes a signal wire 250 that is surrounded by a corresponding insulation layer or jacket 252. In alternative embodiments, the insulated conductors 244, 246 may share the insulation layer 252. For instance, the signal wires 250 may be spaced apart and the insulation layer 252 may be formed around both of the signal wires 250. The signal wires 250 are configured to be terminated to electrical contacts, such as the signal contacts 112, 114 (FIG. 1).

In some embodiments, the communication cable 240 may also include at least one ground conductor that extends along the length of the communication cable 240. For example, the communication cable 240 may include an inner drain wire 254 and/or an outer drain strip 256. The inner drain wire 254 is surrounded by the shielding tape 205. On the other hand, the outer drain strip 256 extends along an exterior of the shielding tape 205 and is located between the shielding tape 205 and the cable jacket 242. The cable jacket 242 may be a plastic tape that is wrapped about the shielding tape 205. Alternatively, the cable jacket 242 may be extruded in a manner such that the cable jacket 242 surrounds the shielding tape 205.

In the illustrated embodiment, the shielding tape 205 immediately surrounds and engages the insulated conductors 244, 246, and the cable jacket 242 immediately surrounds and engages the shielding tape 205. In alternative embodiments, other layers and/or material may be disposed between the cable jacket 242 and the shielding tape 205 or between the shielding tape 205 and the insulated conductors 244, 246.

In some embodiments, the communication cable 240 may be referred to as a twin-axial cable or Twinax cable. For example, the insulated conductors 244, 246 may extend parallel to each other along the length of the communication cable 240. However, the configuration of the communication cable 240 shown in FIG. 6 is just one example of the various configurations that the communication cable 240 may have. For instance, the insulated conductors 244, 246 may not extend parallel to each other and, instead, may form a twisted pair. In other embodiments, the communication cable 240 may include only a single insulated conductor or more than two insulated conductors. Moreover, the communication cable 240 may include more than one pair of insulated conductors, such as four pairs.

The shielding tape 205 is repeatedly wrapped around the insulated conductors 244, 246. The shielding tape 205 may be wrapped in a helical manner such that each of the folded edge 234 and the stacked edge 236 forms a corresponding helix that surrounds the central axis 290. As the shielding tape 205 is wrapped around the insulated conductors 244, 246, the shielding tape 205 overlaps itself. More specifically, FIG. 6 shows a first wrap 260 and a second wrap 262 that overlaps the first wrap 260. Relative to each other, the first wrap 260 may be referred to as the prior wrap and the second wrap 262 may be referred to as the subsequent wrap.

In FIG. 6, the folded edge 234 is the leading edge of the shielding tape 205 such that the folded edge 234 leads the shielding tape 205 as the shielding tape 205 is wrapped helically about the insulated conductors 244, 246. The stacked edge 236 is the trailing edge. By way of example, as the second wrap 262 of the shielding tape 205 is wrapped around the insulated conductors 244, 246, a leading portion 264 of the second wrap 262 surrounds the insulated conductors 244, 246. The leading portion 264 includes the folded edge 234. The folded edge 234 may immediately surround the insulated conductors 244, 246 such that the folded edge 234 engages the insulted conductors 244, 246 or a nominal gap exists therebetween. In addition, as the second wrap 262 of the shielding tape 205 is wrapped around the insulated conductors 244, 246, a trailing portion 266 of the second wrap 262 extends over and covers the first wrap 260. The trailing portion 266 includes the stacked edge 236. The stacked edge 236 extends over and engages the first wrap 260.

The shielding tape 205 has a shield width 268. In some embodiments, the subsequent wrap, such as the second wrap 262 shown in FIG. 6, overlaps at most one-half of the shield width 268 of the prior wrap. In an exemplary embodiment, the subsequent wrap overlaps less than one-half the shield width 268. For example, the subsequent wrap may overlap about one-third of the shield width 268. However, in other embodiments, the subsequent wrap may overlap less than one-third of the shield width 268 or more than one-half of the shield width 268 of the prior wrap.

Figure 7:
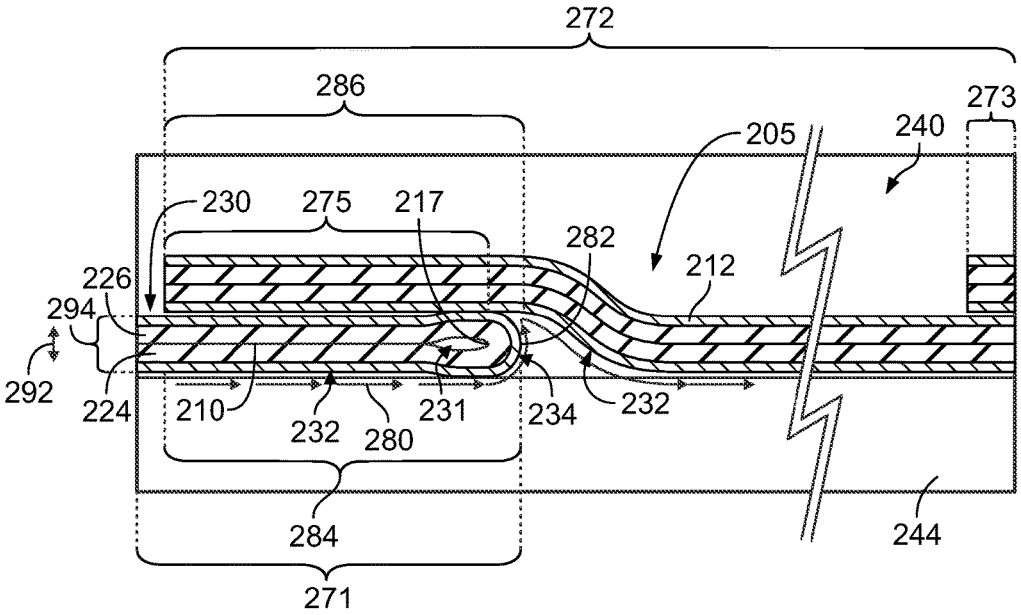
FIG. 7 is a side cross-sectional view of the communication cable illustrating one wrap of the shielding tape overlapping another wrap of the shielding tape.

FIG. 7 is a side cross-sectional view of the communication cable 240. Only the insulated conductor 244 is shown in FIG. 7, but the insulated conductor 246 (FIG. 6) is positioned adjacent to the insulated conductor 244 and is also surrounded by the shielding tape 205. The shielding tape 205 is wrapped a plurality of times about the insulated conductors 244, 246 such that a plurality of wraps 271, 272, 273 of the shielding tape 205 are formed. Only a portion of each of the wraps 271-273 is shown in FIG. 7. Relative to each other, the wrap 271 is the prior wrap and the wrap 272 is the subsequent wrap. Relative to each other, the wrap 272 is the prior wrap and the wrap 273 is the subsequent wrap. The shielding tape 205 is helically wrapped about the insulated conductors 244, 246 such that the inner side 232 faces the insulated conductors 244, 246. In particular embodiments, the inner side 232 directly engages the insulated conductors 244, 246.

Each subsequent wrap of the shielding tape 205 overlaps a portion of the prior wrap. For example, the inner side 232 of the wrap 272 overlaps an underlapped portion 284 of the wrap 271. The inner side 232 of the wrap 272 engages the outer side 230 of the wrap 271. The portion of the wrap 272 that overlaps the wrap 271 may be referred to as the overlapped portion 286 of the wrap 272. In certain embodiments, the shielding tape 205 is constantly overlapping with itself as the shielding tape 205 is helically wrapped about the insulated conductors 244, 246. Each of the inner side 232 and the outer side 230 are portions of the conductive layer 212 and, as such, are electrically conductive. Accordingly, the shielding tape 205 electrically couples to itself along an overlapped area 275.

Unlike conventional shielding tapes, the folded edge 234 does not electrically separate overlapping wraps from each other. The conductive layer 212 includes the folded edge 234. As such, an electrically conductive path 280 (illustrated by a series of arrows) may extend continuously along the length of the communication cable 240. In particular embodiments, the electrically conductive path 280 includes the inner side 232 of the prior wrap, at least a portion of an edge surface 282 of the folded edge 234 of the prior wrap, and, optionally, a portion of the outer side 230 of the prior wrap. The electrically conductive path 280 then extends into a portion of the inner side 232 of the subsequent wrap. Although the arrows that designate the conductive path 280 point in one direction, it should be understood that the conductive path 280 may convey electrical energy in the opposite direction.

In some embodiments, a portion of the insulative layer 210 that is located proximate to the fold line 217 provides a flex force 292 (indicated by the double-headed arrow) that biases or flexes the first and second lateral sections 224, 226 of the prior wrap away from each other. In some embodiments, the flex force 292 may cause the air gap 231 and effectively increase a shield thickness 294 of the shielding tape 205 along the underlapped portion 284 and/or proximate to the folded edge 234. The flex force 292 may be a function of properties of the insulative layer 210. For example, the insulative layer 210 may resist being folded onto itself. The resistance is the flex force 292, which may be greatest near the fold line 217 thereby providing the air gap 231. In such embodiments, the flex force 292 may facilitate electrical contact between the outer side 230 of the prior wrap and the inner side 232 of the subsequent wrap along the overlapped area 275.

Figure 8:
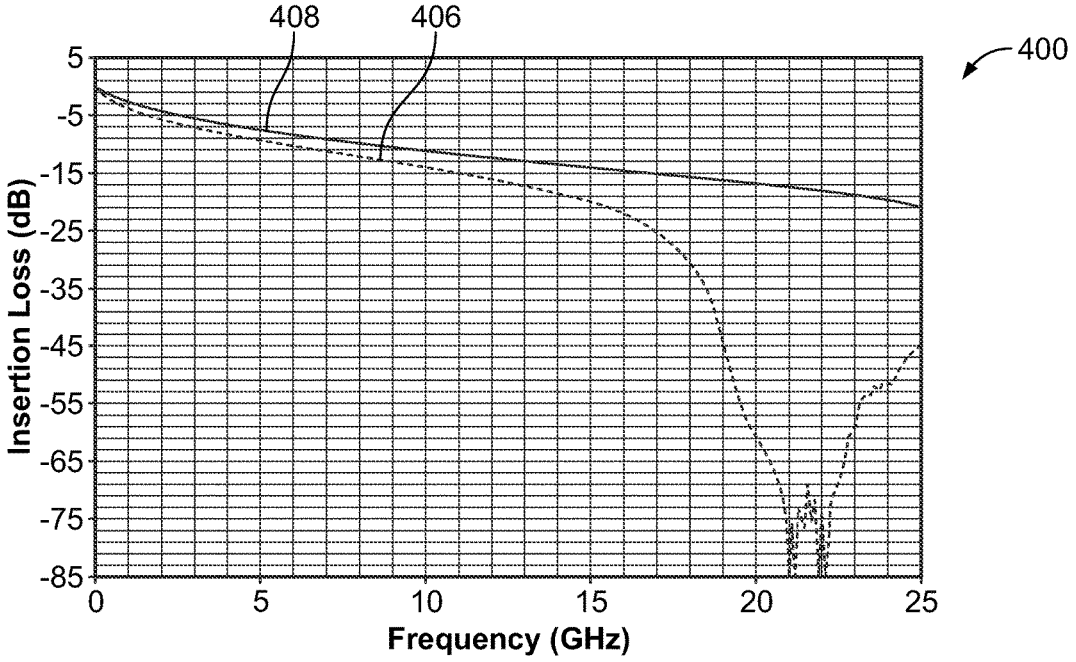
FIG. 8 includes a graph that shows a relationship between insertion loss and transmission frequency for a conventional communication cable and for the communication cable of FIG. 6.

FIG. 8 includes a graph 400 that shows a relationship between insertion loss and transmission frequency for a conventional communication cable (indicated by line 406) and for the communication cable 240 (FIG. 6), which is indicated by line 408 in FIG. 8. The conventional communication cable is a twin-axial cable that is helically wrapped with a conventional shielding tape. As described above, the conventional shielding tape separates the conductive foil of a subsequent wrap from the conductive foil of a prior wrap thereby producing the suck-out effect. As shown in FIG. 8, the insertion loss of the conventional communication cable increases significantly at frequencies above 16 gigahertz (GHz). The insertion loss of the communication cable 240, however, does not increase significantly after 16 GHz. As such, the communication cable 240 may provide an improved electrical performance over the conventional communication cable. For example, the insertion loss of the communication cable 240 at 25 GHz is less than the insertion loss of the conventional communication cable at 16 GHz. In some embodiments, the communication cable 240 is capable of transmitting at a data rate of at least 20 GHz with an insertion loss of less than about 25 decibels. In more particular embodiments, the communication cable 240 is capable of transmitting at a data rate of at least 25 GHz with an insertion loss of less than about 25 decibels.

Accordingly, embodiments set forth herein may reduce the suck-out effect to enable greater data rates than conventional cables that include helically-wrapped shielding. Moreover, embodiments set forth herein include helically-wrapped shielding. As such, embodiments may have a flexibility that is similar to the flexibility of the conventional cables that also have helically-wrapped shielding.

Figure 9:
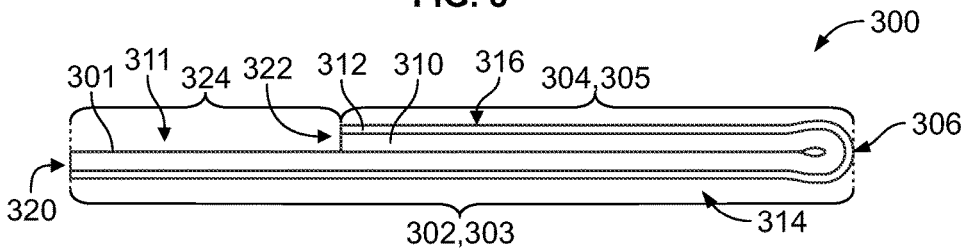
FIG. 9 illustrates an end view of a shielding tape in accordance with an embodiment.

FIG. 9 is a side cross-sectional view of a shielding tape 300. The shielding tape 300 may be formed from a composite tape 301, which may be similar or identical to the composite tape 200 (FIG. 4). The composite tape 301 (or the shielding tape 300) includes first and second lateral sections 302, 304 folded over each other and joined along a folded edge 306. The shielding tape 300 includes an insulative layer 310 and a conductive layer 312. After the shielding tape 300 is folded, the first and second lateral sections 302, 304 form an inner side 314 and an outer side 316, respectively, of the shielding tape 300 and the folded edge 306. The conductive layer 312 defines the inner side 314, the outer side 316, and the folded edge 306.

The first and second lateral sections 302, 304 include first and second longitudinal edges 320, 322, respectively, of the composite tape 301. The first and second lateral sections 302, 304 have unequal section widths 303, 305, respectively, that are measured from the folded edge 306 to the respective longitudinal edges 320, 322. As shown in FIG. 9, the section width 303 may be greater than the section width 305 such that the first and second longitudinal edges 320, 322 are offset with respect to each other. More specifically, the first longitudinal edge 320 extends beyond the second longitudinal edge 322 by a distance or clearance 324. The second longitudinal edge 322 is located closer to the folded edge 306 than the first longitudinal edge 320.

Similar to the shielding tape 205 (FIG. 5), the shielding tape 300 is configured to be helically wrapped about insulation conductors (not shown) such that the subsequent wrap overlaps with a prior wrap. In some embodiments, the shielding tape 300 includes an overlapped portion 311 that corresponds to the distance 324. The distance 324 may be configured relative to a distance of the underlapped portion (not shown) of the prior wrap. For example, the distance 324 may be slightly greater than the distance of the underlapped portion. In such embodiments, a total thickness of the shielding tape 300 may be reduced.

Figure 10:
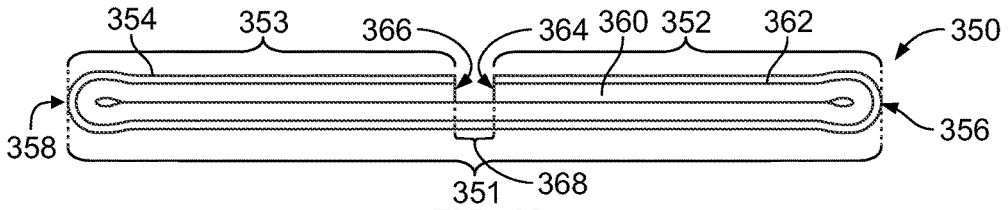
FIG. 10 illustrates an end view of a shielding tape in accordance with an embodiment.

FIG. 10 is a side cross-sectional view of a shielding tape 350 that is formed from a composite tape 354. The composite tape 354 may be similar or identical to the composite tape 200 (FIG. 4). The composite tape 354 includes first, second, and third lateral sections 351, 352, 353 that are folded with respect to one another. The composite tape 354 comprises an insulative layer 360 and a conductive layer 362. As shown, the first and second lateral sections 351, 352 are folded over each other to form a first folded edge 356. The first and third lateral sections 351, 353 are folded over each other to form a second folded edge 358. The conductive layer 362 defines the first and second folded edges 356, 358. Also shown, the second lateral section 352 includes a longitudinal edge 364, and the third lateral section 353 includes a longitudinal edge 366. The longitudinal edges 364, 366 are located above the first lateral section 351 and are separated from each other by a gap 368.

Figure 11:
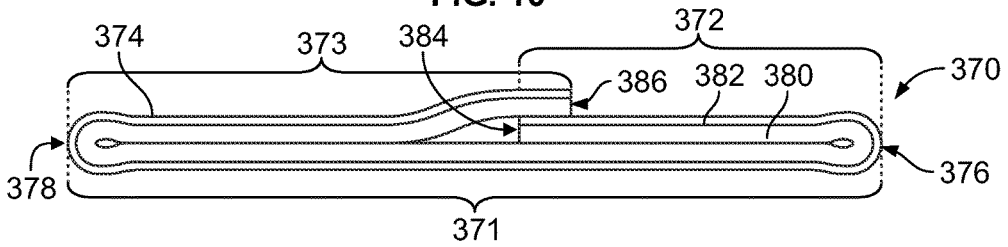
FIG. 11 illustrates an end view of a shielding tape in accordance with an embodiment.

FIG. 11 is a side cross-sectional view of a shielding tape 370 that is formed from a composite tape 374. The composite tape 374 may be similar or identical to the composite tape 200 (FIG. 4). The composite tape 374 includes first, second, and third lateral sections 371, 372, 373 that are folded with respect to one another. The shielding tape 370 comprises an insulative layer 380 and a conductive layer 382. As shown, the first and second lateral sections 371, 372 of the shielding tape 350 are folded over each other to form a first folded edge 376. The first and third lateral sections 371, 373 are folded over each other to form a second folded edge 378. The conductive layer 382 defines the first and second folded edges 376, 378. Also shown, the second lateral section 372 includes a longitudinal edge 384, and the third lateral section 373 includes a longitudinal edge 386. The longitudinal edge 384 is located above the first lateral section 371. However, the third lateral section 373 overlaps with the second lateral section 372 such that the longitudinal edge 386 is located above the second lateral section 372.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A communication cable comprising:

insulated conductors; and a composite tape comprising an insulative layer and a conductive layer, the composite tape including first, second, and third lateral sections that are folded to form a shielding tape, the first and second lateral sections being folded over each other to form a first folded edge, the first and third lateral sections being folded over each other to form a second folded edge, the first and second folded edges being opposite each other and defined by the conductive layer;

wherein the shielding tape includes an inner side defined by the conductive layer along the first lateral section and an outer side defined by the conductive layer along the second lateral section and along the third lateral section, the shielding tape being wrapped helically about the insulated conductors a plurality of times along a length of the communication cable to form a plurality of wraps;

wherein the inner side faces the insulated conductors and the first folded edge leads the shielding tape when the shielding tape is wrapped helically about the insulated conductors, the inner side of a subsequent wrap of the shielding tape overlapping a portion of the outer side of a prior wrap of the shielding tape and the first folded edge, the portion of the outer side of the prior wrap including the conductive layer along the second lateral section, the first folded edge of the prior wrap extending between and electrically coupling the inner side of the prior wrap to the inner side of the subsequent wrap, wherein the second and third lateral sections include respective longitudinal edges, the longitudinal edges being located above the first lateral section and separated from each other by a gap.

2. The communication cable of claim 1, wherein the composite tape is folded along a fold line when the shielding tape is formed, the insulative layer providing a flex force that biases the first and second lateral sections away from each other such that an air gap is formed between the first and second lateral sections proximate to the fold line, the air gap increasing a shield thickness of the shielding tape proximate to the fold line, the flex force facilitating electrical contact between the outer side of the prior wrap and the inner side of the subsequent wrap.

3. The communication cable of claim 1, wherein the composite tape is folded along a fold line when the shielding tape is formed, the composite tape including an adhesive along a side surface of the insulative layer that joins the first and second lateral sections, the composite tape being devoid of the adhesive along the side surface proximate to the fold line.

4. The communication cable of claim 1, wherein the shielding tape has a shield width, the subsequent wrap overlapping at most one-half of the shield width of the prior wrap, the inner side of underlapped portions that are overlapped by subsequent wraps and the first folded edges forming an electrically conductive path that extends continuously along a length of the communication cable.

5. The communication cable of claim 1, further comprising a ground conductor that extends along the length of the communication cable and a cable jacket that surrounds the ground conductor, the shielding tape, and the insulated conductors, the shielding tape being wrapped about the ground conductor and the insulated conductors.

6. The communication cable of claim 1, wherein the insulated conductors include a parallel-pair of insulated conductors.

7. The communication cable of claim 6, wherein the communication cable is capable of transmitting at a data rate of at least 20 GHz with an insertion loss of less than about 25 decibels.

8. A cable assembly comprising:

a cable bundle of communication cables; and a cable connector including a plurality of contact modules that form a two-dimensional contact array of the cable connector, the contact modules being electrically coupled to corresponding communication cables of the cable bundle, wherein at least one of the communication cables is the communication cable of claim 1.

9. The cable assembly of claim 8, wherein the composite tape is folded along a fold line when the shielding tape is formed, the insulative layer providing a flex force that biases the first and second lateral sections away from each other such that an air gap is formed between the first and second lateral sections proximate to the fold line, the air gap increasing a shield thickness of the shielding tape proximate to the fold line, the flex force facilitating electrical contact between the outer side of the prior wrap and the inner side of the subsequent wrap.

10. The cable assembly of claim 8, wherein the composite tape is folded along a fold line when the shielding tape is formed, the composite tape including an adhesive along a side surface of the insulative layer that joins the first and second lateral sections, the composite tape being devoid of the adhesive along the side surface proximate to the fold line.

11. The cable assembly of claim 8, wherein the second and third lateral sections overlap each other.

12. The cable assembly of claim 8, wherein the second and third lateral sections include respective longitudinal edges, the longitudinal edges being located above the first lateral section and separated from each other by a gap.

13. The cable assembly of claim 8, wherein the shielding tape has a shield width, the subsequent wrap overlapping at most one-half of the shield width of the prior wrap, the inner side of underlapped portions that are overlapped by subsequent wraps and the first folded edges forming an electrically conductive path that extends continuously along a length of the communication cable.

14. The cable assembly of claim 8, further comprising a ground conductor that extends along the length of the communication cable and a cable jacket that surrounds the ground conductor, the shielding tape, and the insulated conductors, the shielding tape being wrapped about the ground conductor and the insulated conductors.

15. The cable assembly of claim 8, wherein the insulated conductors include a parallel-pair of insulated conductors.

16. The cable assembly of claim 15, wherein the communication cable is capable of transmitting at a data rate of at least 20 GHz with an insertion loss of less than about 25 decibels.

* * * * *